US008316494B2

(12) United States Patent
Yang et al.

(10) Patent No.: US 8,316,494 B2
(45) **Date of Patent: *Nov. 27, 2012**

(54) WASHING MACHINE AND METHOD FOR CONTROLLING THE SAME

(75) Inventors: Byoung Yull Yang, Ansan-si (KR); Hyung Gyoon Kim, Suwon-si (KR); Sang Yeon Pyo, Suwon-si (KR); Seon Woo Park, Suwon-si (KR); Hye Soon Yang, Yongin (KR); Seong Min Oak, Masan (KR); Seung Ju Choi, Suwon-si (KR); Jae-Ryong Park, Suwon-si (KR); Hyun Sook Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/019,537

(22) Filed: Feb. 2, 2011

(65) Prior Publication Data

US 2011/0119838 A1 May 26, 2011

Related U.S. Application Data

(60) Continuation of application No. 12/115,985, filed on May 6, 2008, now Pat. No. 7,904,980, which is a division of application No. 10/901,175, filed on Jul. 29, 2004, now Pat. No. 7,490,491.

(30) Foreign Application Priority Data

Jan. 6, 2004 (KR) ..... 2004-679

(51) Int. Cl.
*D06F 29/00* (2006.01)
*D06F 33/02* (2006.01)
*D06F 39/00* (2006.01)

(52) U.S. Cl. ..... 8/149.1; 8/149.3; 8/159

(58) Field of Classification Search ..... 8/149.1, 8/149.3, 158, 159; 68/5 R, 5 C, 12.03, 12.22, 68/23 R See application file for complete search history.

(56) References Cited

U.S. PATENT DOCUMENTS 3,073,668 A 1/1963 Rothenberger
5,504,954 A * 4/1996 Joo et al. ..... 8/158
5,520,025 A * 5/1996 Joo et al. ..... 68/12.05

(Continued)

FOREIGN PATENT DOCUMENTS

DE 2315848 10/1974

(Continued)

OTHER PUBLICATIONS

English translation of EP 816550 A1, no date.*

(Continued)

*Primary Examiner* — Joseph L Perrin
(74) *Attorney, Agent, or Firm* — Sughrue Mion, PLLC

(57) ABSTRACT

A washing machine in which the poor heat-resistant laundry is sufficiently wet so that a plurality of water curtain layers are formed at the laundry, thereby preventing the laundry from being stained and damaged when the laundry contacts the steam. According to the present invention, cold water is supplied simultaneously with injection of the steam so that the real temperature of the steam contacting the surfaces of the laundry is lowered, thereby preventing the laundry from being stained and damaged when the laundry contacts the steam.

6 Claims, 8 Drawing Sheets

U.S. PATENT DOCUMENTS

| | | | | |
|---|---|---|---|---|
| 6,029,298 | A * | 2/2000 | Dausch et al. | 8/159 |
| 6,612,138 | B2 * | 9/2003 | Ryu et al. | 68/58 |
| 6,843,079 | B2 | 1/2005 | Hird | |
| 6,849,094 | B1 * | 2/2005 | North | 8/149.1 |
| 2004/0025539 | A1 | 2/2004 | Fischer et al. | |
| 2004/0187529 | A1 | 9/2004 | Kim et al. | |
| 2004/0255391 | A1 * | 12/2004 | Kim et al. | 8/149.3 |
| 2005/0000033 | A1 * | 1/2005 | Park et al. | 8/159 |
| 2006/0000242 | A1 | 1/2006 | Yang et al. | |
| 2006/0151005 | A1 | 7/2006 | Kim et al. | |

FOREIGN PATENT DOCUMENTS

| | | | |
|---|---|---|---|
| EP | 816550 | A1 * | 1/1998 |
| EP | 1275767 | A | 1/2003 |
| EP | 1469120 | A | 10/2004 |
| EP | 1507032 | A | 2/2005 |
| EP | 1619284 | A | 1/2006 |
| GB | 799788 | | 8/1958 |
| JP | 62-66891 | | 3/1987 |
| JP | 04-158896 | A | 6/1992 |
| JP | 2003-093775 | A | 4/2003 |
| JP | 2003311084 | A * | 11/2003 |

OTHER PUBLICATIONS

Extended European Search Report issued in Application No. 10174211.2, dated Oct. 27, 2010.

* cited by examiner

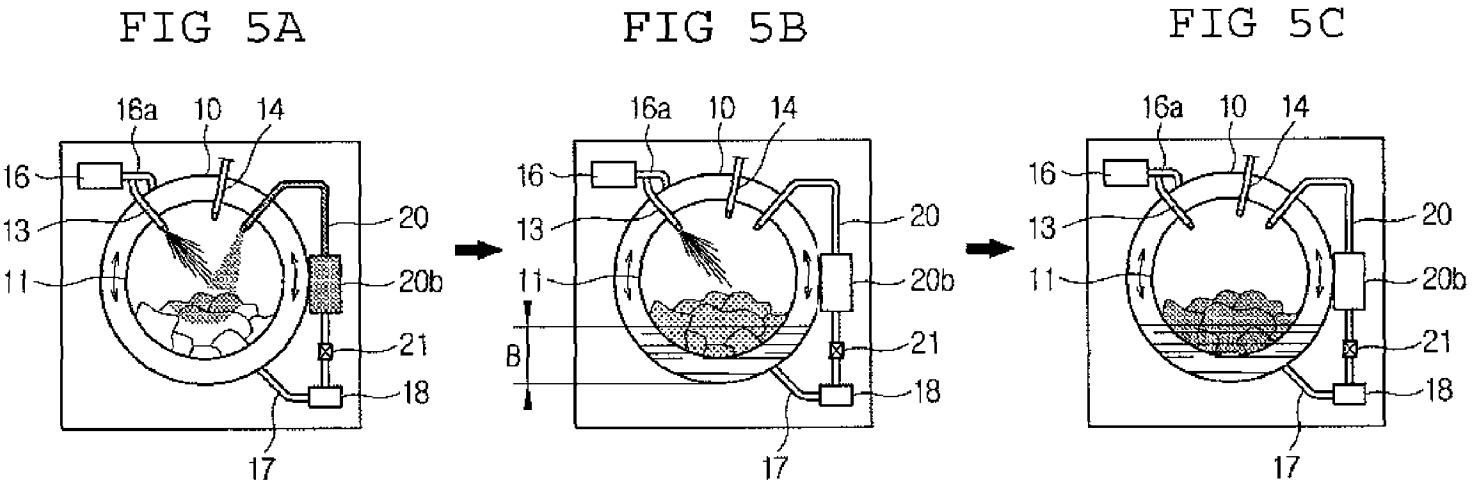
FIG 5A
FIG 5B
FIG 5C
16a
10
14
16
13
11
20
20b
21
18
17
B
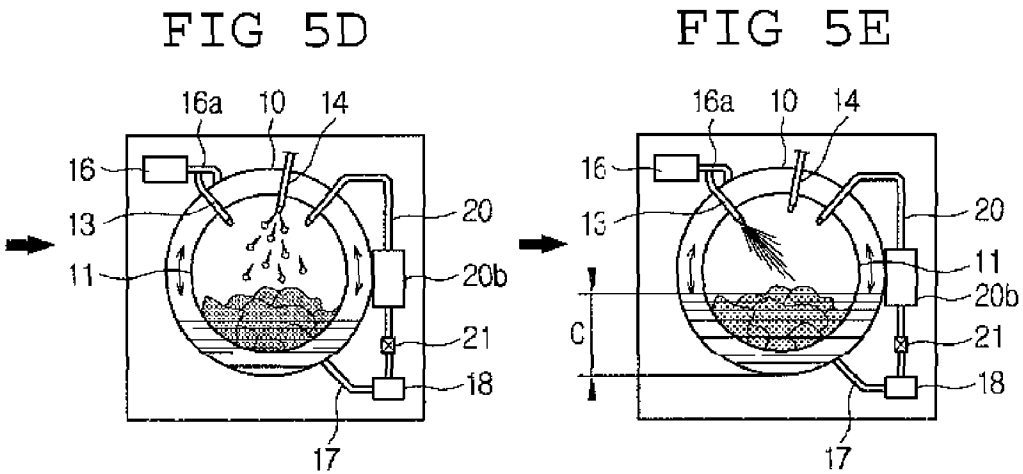
FIG 5D
FIG 5E
16a
10
14
16
13
11
20
20b
21
18
17
C 16
16a
10
14
13
11
20
20b
21
18
17
A
C

WASHING MACHINE AND METHOD FOR CONTROLLING THE SAME

CROSS-REFERENCE TO RELATED APPLICATION

This application claims the benefit of Korean Patent Application No. 2004-679, filed on Jan. 6, 2004 in the Korean Intellectual Property Office, the disclosure of which is incorporated herein by reference.

BACKGROUND OF THE INVENTION

1. Field of the Invention

The present invention relates to a washing machine, and more particularly to a washing machine that is capable of washing delicate cloths with steam. The present invention also relates to a method of controlling such a washing machine.

2. Description of the Related Art

For a conventional washing machine, a washing process is set on the basis of materials of the laundry. The washing temperature and the number of rinsing times are also set on the basis of materials of the laundry. Water is heated by means of a heater disposed in a water tub of the washing machine so that the heated water is used as wash water.

After a prescribed amount of water is supplied to the conventional washing machine, the washing machine heats water supplied into the washing tub using the heater until the temperature of the water reaches a prescribed washing temperature. As the reverse turn of the washing tub is repeated, a detergent supplied along with the water is dissolved, whereby the washing operation is carried out.

The conventional washing machine requires an installation space of the heater, which is provided at the lower part of the washing tub for heating water. As a result, the size of the conventional washing machine is increased, which requires a corresponding increase in water. Also, a large amount of water is necessary to dissolve the detergent, which leads to further consumption of electric energy and increase of the washing time.

To this end, a washing machine has been developed that is capable of washing the laundry with steam to reduce the amount of water to be used. When hot steam contacts the laundry, however, the laundry may be damaged due to the high temperature of the steam. Furthermore, when the hot steam contacts the surfaces of the poor heat-resistant laundry, such as wool, silk, or delicate clothes, the laundry is easily damaged. When the hot steam contacts the detergent applied to the clothes, on the other hand, the detergent sticks to the clothes. As a result, the washed clothes are stained. Therefore, it is required that the washing process be carried out at a suitable washing temperature when the laundry is to be washed using steam.

SUMMARY OF THE INVENTION

Therefore, an object of the invention is to provide a washing machine that is capable of preventing the laundry from being stained and damaged due to hot steam when the laundry is washed using the steam, and further preventing the poor heat-resistant laundry from being damaged due to the hot steam when the laundry is washed using the steam.

Another object of the invention is to provide a method of controlling such a washing machine.

In accordance with one aspect, the present invention provides a washing machine comprising: a rotary drum for accommodating the laundry; a water supply unit; a steam generating unit; and a controller for controlling a washing operation, wherein when the laundry is washed with steam, the controller sets the amount of wetting water necessary to wet the laundry, controls the water supply unit so that the set amount of wetting water is supplied, and controls the steam generating unit so that the laundry is washed with the generated steam.

In accordance with another aspect, the present invention provides a washing machine comprising: a rotary drum for accommodating the laundry; a water supply unit; a steam generating unit; and a controller for controlling a washing operation, wherein, when the laundry is washed with steam, the controller sets the amount of wetting water necessary to wet the laundry, controls the water supply unit so that the set amount of wetting water is supplied, and, if the laundry has poor heat resistance, controls the steam generating unit and the water supply unit so that steam and water are simultaneously supplied into the rotary drum.

In accordance with another aspect, the present invention provides a washing machine comprising: a rotary drum for accommodating the laundry; a water supply unit; a steam generating unit; and a controller for controlling a washing operation, wherein, when the laundry, having poor heat resistance, is washed with steam, the controller resets the initial amount of wetting water necessary to wet the laundry, controls the water supply unit so that the reset amount of wetting water is supplied, and controls the steam generating unit and the water supply unit so that steam and water are simultaneously supplied into the rotary drum.

In accordance with another aspect, the present invention provides a method of controlling a washing machine that performs a washing operation using steam, comprising the steps of: setting the amount of wetting water necessary to wet the laundry in a rotary drum when a steam washing operation is selected; supplying the set amount of wetting water; and supplying steam to the wet laundry.

In accordance with another aspect, the present invention provides a method of controlling a washing machine that performs a washing operation using steam, comprising the steps of: setting the amount of wetting water necessary to wet the laundry in a rotary drum when a steam washing operation is selected; supplying the set amount of wetting water; and, when the laundry has poor heat resistance, simultaneously supplying steam and water into the rotary drum having the wet laundry accommodated therein.

In accordance with still another aspect, the present invention provides a method of controlling a washing machine that performs a washing operation using steam, comprising the steps of: when the laundry, having poor heat resistance, is washed with steam, resetting the initial amount of wetting water necessary to wet the laundry in a rotary drum; supplying the reset amount of wetting water; and simultaneously supplying steam and water into the rotary drum having the wet laundry accommodated therein.

BRIEF DESCRIPTION OF THE DRAWINGS

The above objects, and other features and advantages of the present invention will become more apparent after reading the following detailed description when taken in conjunction with the drawings, in which:

FIGS. 5A to 5E are schematic views illustrating respective washing steps in accordance with the control method shown in FIG. 4;

DETAILED DESCRIPTION OF THE PREFERRED EMBODIMENTS

Preferred embodiments of the present invention will now be described in detail with reference to the accompanying drawings.

Figure 1:
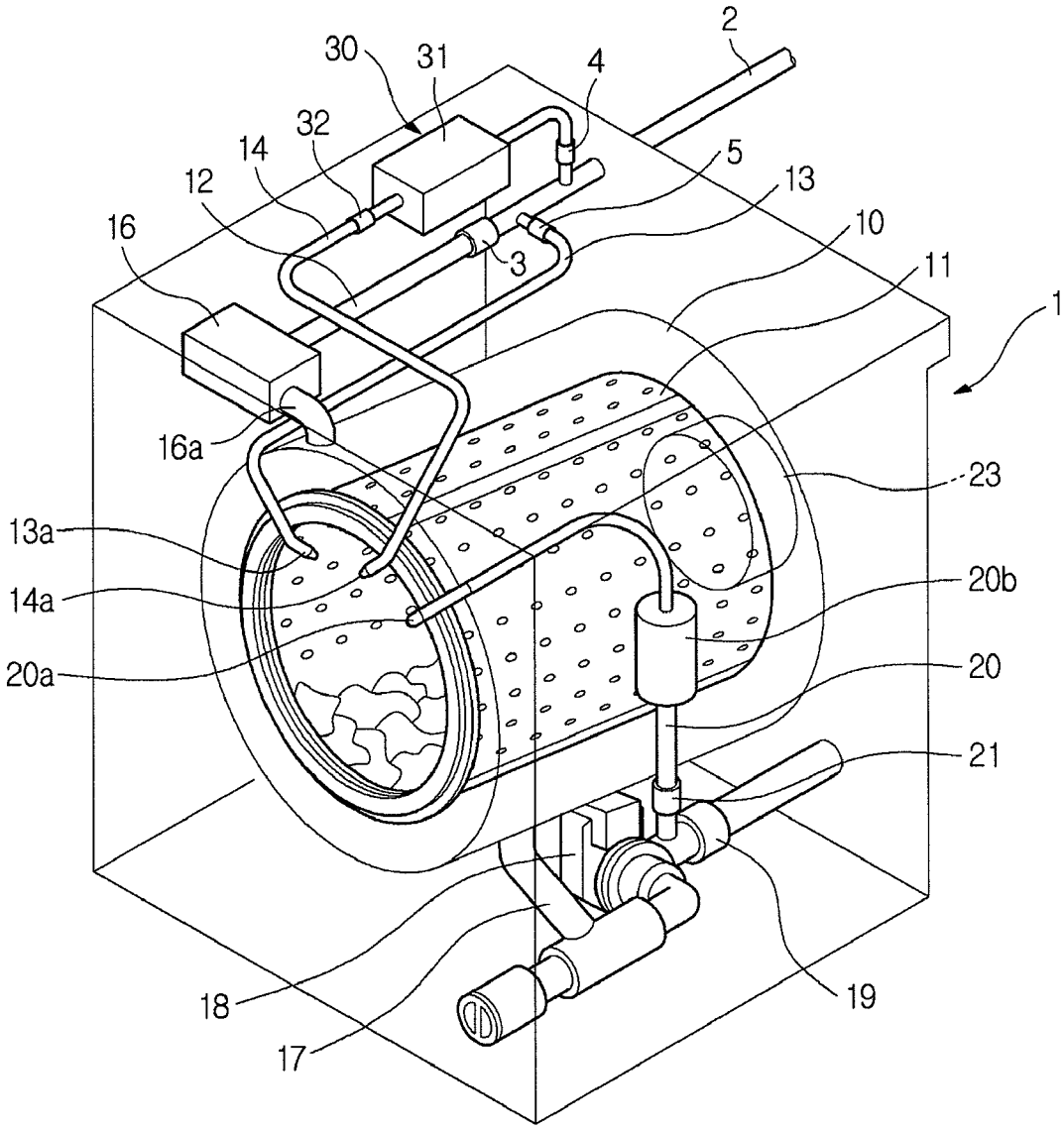
FIG. 1 is a view illustrating the configuration of a washing machine according to an embodiment of the present invention.

FIG. 1 is a view illustrating the configuration of a washing machine according to an embodiment of the present invention, for example, a drum washing machine with a steam-generating unit equipped thereto.

The drum washing machine according to the present invention includes: a first water supply pipe 12 for supplying water introduced from an external water pipe 2 to a water tub 10; a third water supply pipe 13 for supplying the water into a rotary drum 11; and a second water supply pipe 14 for supplying the water to a heating tank 31 of a steam-generating unit 30.

The first water supply pipe 12 is provided with a first water supply valve 3 and a detergent storage box 16. The detergent storage box 16 serves to store a powder detergent. The water supplied through the first water supply valve 3 passes through the detergent storage box 16, and is then discharged along with the powder detergent through an outlet pipe 16*a* so that the water is introduced into the water tub 10.

The third water supply pipe 13 is provided with a third water supply valve 5 for supplying the water to the rotary drum 11. At the end of the third water supply pipe 13 is disposed an injection nozzle 13*a* for injecting the water into the rotary drum 11.

At the bottom of the water tub 10 is disposed a drain pipe 17. In the drain pipe 17 is mounted a pump motor 18 for pumping out the water and the detergent at the bottom of the water tub 10, and a drain valve 19. Between the pump motor 18 and the drain valve 19 is disposed a connection pipe 20, which is branched from the drain pipe 17. One end of the connection pipe 20 is connected to the drain pipe, and the other end of the connection pipe 20 is extended to the inlet of the rotary drum 11. In the middle of the connection pipe 20 is formed a cylindrical detergent dissolving space 20*b* having a diameter larger than that of the connection pipe 20. At the end of the connection pipe 20 is provided an injection nozzle 20*a* for injecting the detergent solution into the rotary drum 11.

At the connection pipe 20 is disposed a backward-flow preventing valve 21. When the drain valve 19 is opened while the flow channel is intercepted by means of the backward-flow preventing valve 21, the water pumped by means of the pump motor 18 is discharged to the outside without flowing backward to the connection pipe above the backward-flow preventing valve 21. When the drain valve 19 is closed while the flow channel is not intercepted by means of the backward-flow preventing valve 21, the water pumped by means of the pump motor 18 is introduced into the connection pipe above the backward-flow preventing valve 21.

To one side of the rotary drum 11 is mounted a drum motor 23, which is rotatable in a forward or reverse direction. The rotary drum 11 can be alternately rotated in one direction and in the opposite direction by means of the drum motor 23.

The steam-generating unit 30, which heats the water supplied through a second water supply valve 4, is connected to the second water supply pipe 14. The steam-generating unit 30 is provided with the heating tank 31. In the heating tank are mounted a heater for heating water to generate steam, a level sensor for detecting the level of the water, and a temperature sensor for detecting the temperature of the water. At the outlet of the steam-generating unit 30 is provided a steam supply valve 32.

Figure 2:
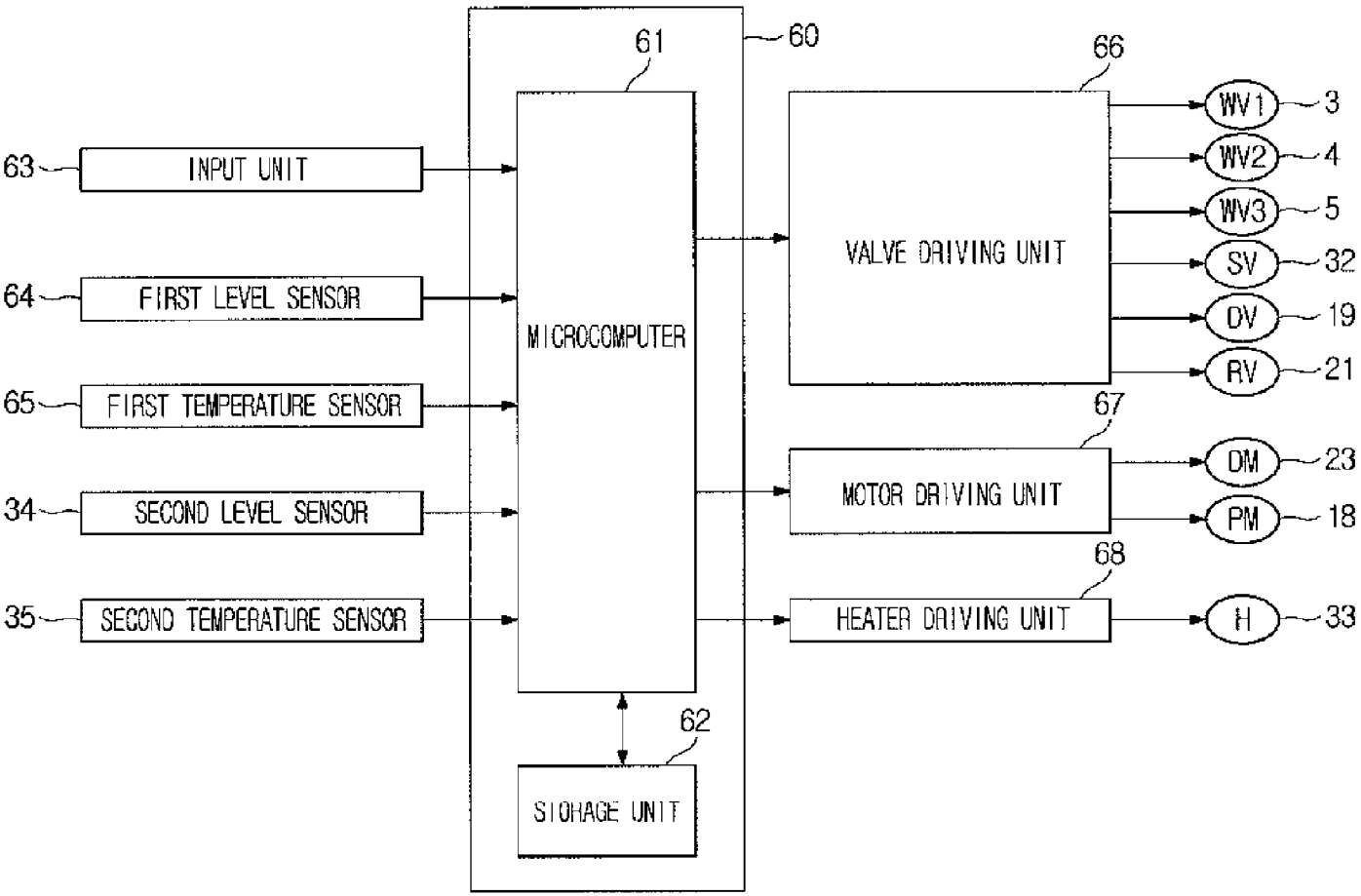
FIG. 2 is a block diagram applied to the washing machine shown in FIG. 1.

FIG. 2 is a block diagram applied to the washing machine shown in FIG. 1.

The washing machine of the present invention further comprises a controller 60 for controlling the overall operation of the washing machine. The controller 60 includes a microcomputer 61 and a storage unit 62. The storage unit 62 stores information for washing the laundry with steam, such as wash water level, washing time, etc.

To the inlets of the microcomputer 61 are connected an input unit 63 for setting input instructions, which are set by means of a user, a first level sensor 64 mounted at a prescribed position of the water tub for detecting the level of water filled in the water tub, a first temperature sensor 65 mounted at a prescribed position of the water tub for detecting the temperature of water filled in the water tub, a second level sensor 34 mounted at a prescribed position of the heating tank 31 for detecting the level of water filled in the heating tank, and a second temperature sensor 35 mounted at a prescribed position of the heating tank for detecting the temperature of water filled in the heating tank.

To the outlets of the microcomputer 61 are connected a water supply valve driving unit 66 for driving the first to third water supply valves 3 to 5, the steam supply valve 32, the drain valve 19, and the backward-flow preventing valve 21, a motor driving unit 67 for driving the drum motor 23 and the pump motor 18, and a heater driving unit 68 for driving a steam-generating heater 33.

The microcomputer 61 controls the overall operation of washing the laundry with steam.

Figure 3:
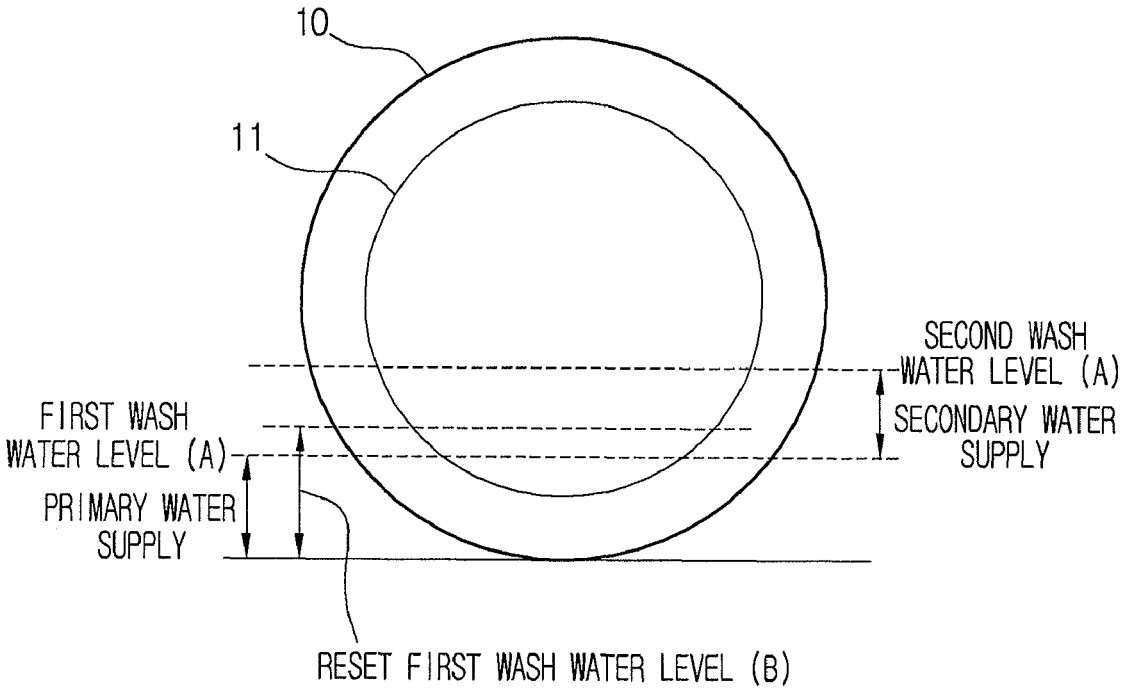
FIG. 3 is a view illustrating wash water levels applied to the washing machine shown in FIG. 1.

When the laundry is washed with steam in accordance with to a first embodiment of the present invention, the total amount of the wash water required to wash the laundry is not supplied all at once. The water supply operations, which are applied to the present invention, are divided into a first water supply operation ((A) of FIG. 3) for supplying simply water and a second water supply operation ((B) of FIG. 3) for supplying water during washing with steam. Specifically, the first water supply operation is a primary water supply operation for supplying water to a first wash water level so that the laundry is wet when the washing operation is initiated, as shown in FIG. 3. On the other hand, the second water supply operation is a secondary water supply operation for supplying water to a second wash water level so that the water is supplemented while the laundry is washed with steam, as shown in FIG. 3. The first and second wash water levels are previously set on the basis of the weights of the laundry.

Furthermore, the first wash water level for the primary water supply is reset ((B) of FIG. 3) when the poor heat-resistant laundry, such as wool, silk, or delicate clothes, is to be washed. At this time, the reset first wash water level is set larger than the previously set amount of water so that the poor heat-resistant laundry is sufficiently wet. Especially for the laundry with low heat-resistance, it is necessary that the reset water level be set much higher. The reset information is stored in the storage unit 62. As the first wash water level is reset, the amount of wash water through the first water supply operation is increased. Consequently, a plurality of water curtain layers are formed at the laundry, thereby preventing the laundry from being stained and damaged when the laundry contacts the hot steam.

Figure 4:
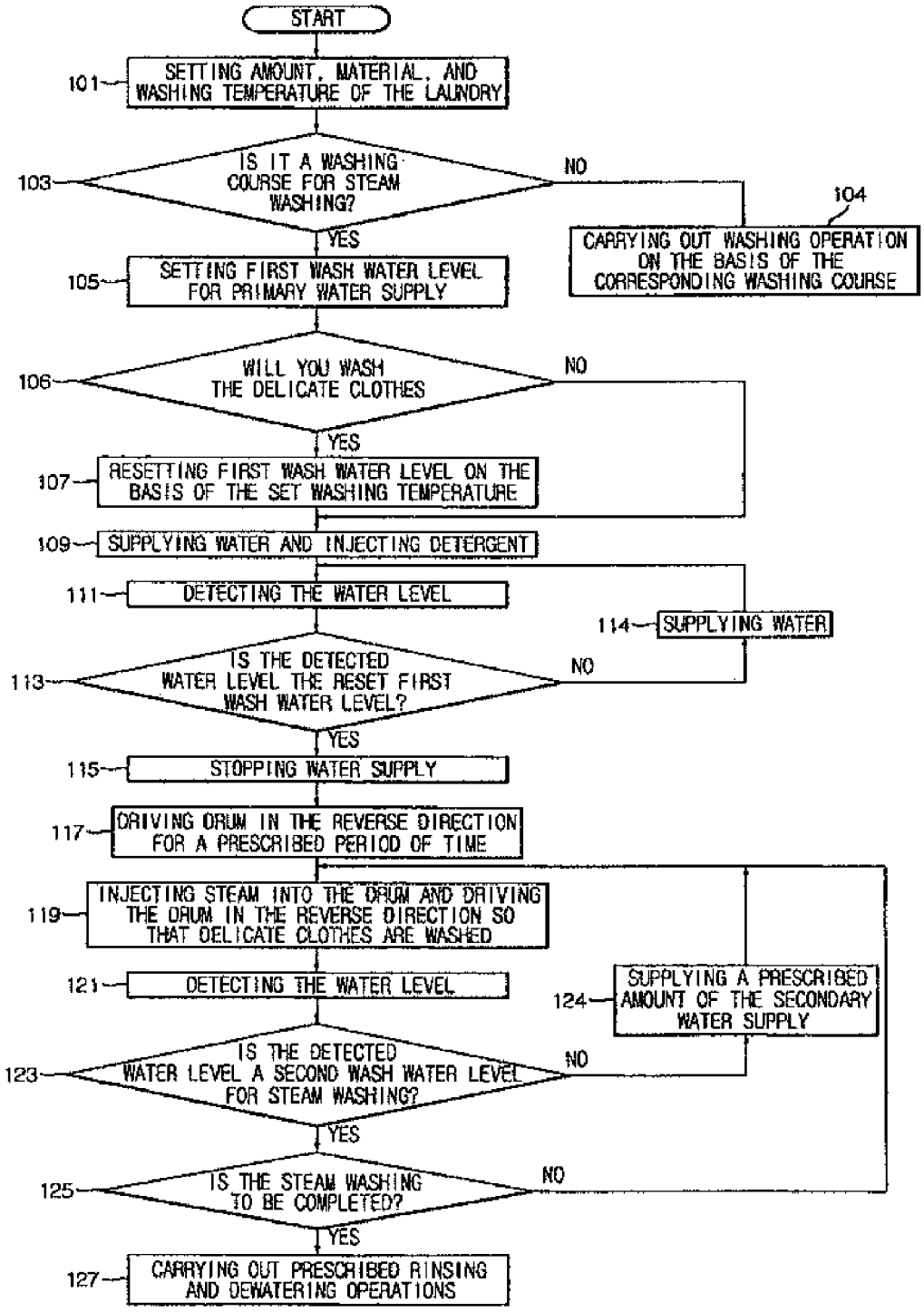
FIG. 4 is a flow chart illustrating a method of controlling a washing machine in accordance with a first embodiment of the present invention.

FIG. 4 is a flow chart illustrating a method of controlling a washing machine in accordance with a first embodiment of the present invention, and FIGS. 5A to 5E are schematic views illustrating respective washing steps in accordance with the control method shown in FIG. 4 especially when the laundry is washed using steam.

After the laundry to be washed is put in the rotary drum 11 and a door, which is not shown, is closed, the amount, the material, and the washing temperature of the laundry are set on the basis of setting instructions of a user, which are inputted from the input unit 63 (S101). The microcomputer 61 determines whether it is a washing course for washing the laundry with steam (S103). If it is not determined that the laundry is to be washed with the steam, for example, if it is another washing course for washing the laundry with cold water and a detergent, the washing operation is carried out on the basis of the corresponding washing course (S104).

If it is determined that the laundry is to be washed with the steam at Step S103, the first wash water level for the primary water supply is set by means of the microcomputer 61. The first wash water level A is set on the basis of the amount of the laundry set at Step S101 (S105). The information of the first wash water level A on the basis of the amount of the laundry is previously stored in the storage unit 62.

The microcomputer 61 at Step S106 determines whether the laundry includes delicate clothes. When it is determined that the laundry includes the delicate clothes, the microcomputer 61 resets the first wash water level at Step S107. The reset first wash water level B is set higher than the previously set first wash water level A so that the delicate clothes are sufficiently wet (S107).

The microcomputer 61 controls the water supply valve driving unit 66 so that the third water supply valve 5 is opened. Consequently, water introduced from the external water pipe 2 is supplied into the rotary drum through the injection nozzle 13*a* so that the laundry is wet. At the same time, the microcomputer 61 controls the water supply valve driving unit 66 so that the first water supply valve 3 is opened. Consequently, a powder detergent is supplied into the water tub along with the water introduced through the first water supply pipe 12. The microcomputer 61 also controls the motor driving unit 67 so that the pump motor 18 is driven. Consequently, the water and the powder detergent are supplied into the cylindrical detergent dissolving space 20*b*, where the water and the powder detergent are mixed to obtain a detergent solution. After the detergent solution is obtained, the motor driving unit 67 is controlled by means of the microcomputer 61 so that the pump motor 18 is driven. As a result, the detergent solution in the detergent dissolving space is injected into the rotary drum through the injection nozzle 20*a* so that the detergent solution is sprayed onto the laundry. At this time, the motor driving unit 67 is controlled by means of the microcomputer 61 so that the rotary drum is driven in the reverse direction (S109) (Refer to FIG. 5A).

While the water is supplied, the level of the water in the water tub is detected by means of the first level sensor 64. The microcomputer 61 determines whether the detected level is the reset first wash water level B (S113). If it is determined that the detected level is not the reset first wash water level B, the rotary drum is driven in the reverse direction as shown in FIG. 5B so that water is continuously supplied (S114).

If it is determined that the detected level is the reset first wash water level B at Step S113, the valve driving unit 66 is controlled by means of the microcomputer 61 so that the water supply is stopped as shown in FIG. 5C (S115), and the rotary drum is driven in the reverse direction for a prescribed period of time (S117).

Consequently, the delicate clothes are sufficiently wetted. At this time, the microcomputer 61 controls the valve driving unit 66 to open the second water supply valve 4 so that a prescribed amount of water is filled in the heating tank 31. The second water supply valve 4 is closed on the basis of the water level detected by means of the second level sensor 34. At the same time, the microcomputer 61 controls the heater driving unit 68 so that the heater 33 is driven. As the heater is driven, the water in the heating tank is heated. When the water is heated and thus steam is generated in the heating tank, the microcomputer 61 controls the valve driving unit 66 so that the steam supply valve 32 is opened. As a result, the hot steam generated in the heating tank is injected into the rotary drum through the injection nozzle 14*a* of the second water supply pipe 14. Also, the microcomputer 61 controls the motor driving unit 67 so that the rotary drum is driven in the reverse direction. At this time, the sufficiently wet delicate clothes are not stained or damaged although the clothes contact the hot steam, whereby the steam washing operation is satisfactorily carried out (S119) (Refer to FIG. 5D).

While the laundry is washed with the steam, the water level in the water tub is detected by means of the first level sensor 64 (S121). It is determined by means of the microcomputer 61 whether the detected level is the second wash water level C for steam washing (S123). If it is determined that the detected level is not the second wash water level C, the rotary drum is driven in the reverse direction as shown in FIG. 5E so that a prescribed amount of water is supplemented (S124), and it is returned to Step S119 so that the steam washing operation is carried out.

If it is determined that the detected level is the second wash water level C at Step S123, the water supply is stopped, and it is determined by means of the microcomputer 61 whether the steam washing operation is to be completed (S125). If it is determined that the steam washing operation is not to be completed, it is returned to Step S119 so that the steam washing operation is carried out.

If it is determined that the steam washing operation is to be completed at Step S125, prescribed rinsing and dewatering operations are carried out (S127).

According to a second embodiment of the present invention, cold water is supplied simultaneously when the steam is injected so that the temperature of the steam contacting the surface of the poor heat-resistant laundry, such as wool, silk, or delicate clothes, is lowered, thereby preventing the laundry from being stained and damaged when the laundry contacts the steam.

Figure 6A:
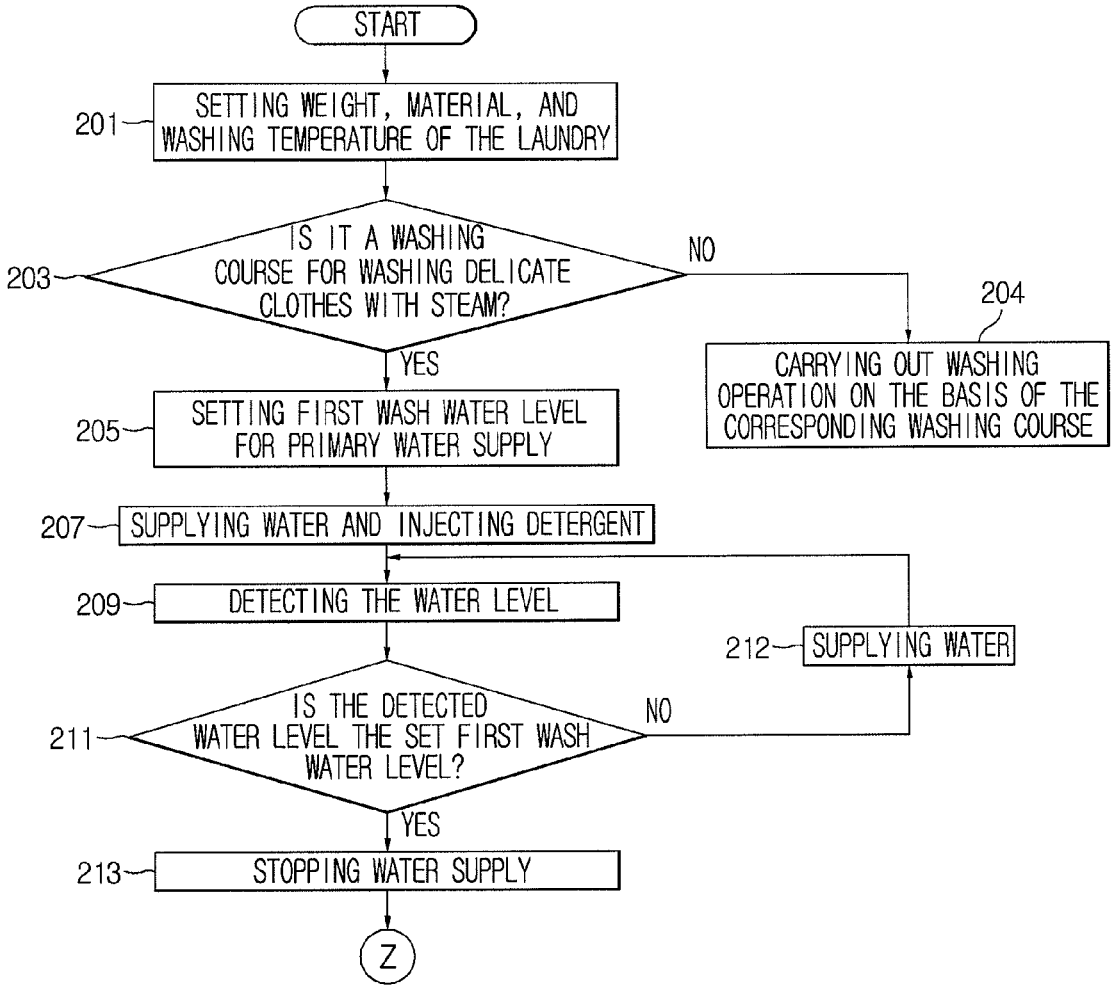
FIGS. 6A and 6B are flow charts illustrating a method of controlling a washing machine in accordance with a second embodiment of the present invention.
Figure 6B:
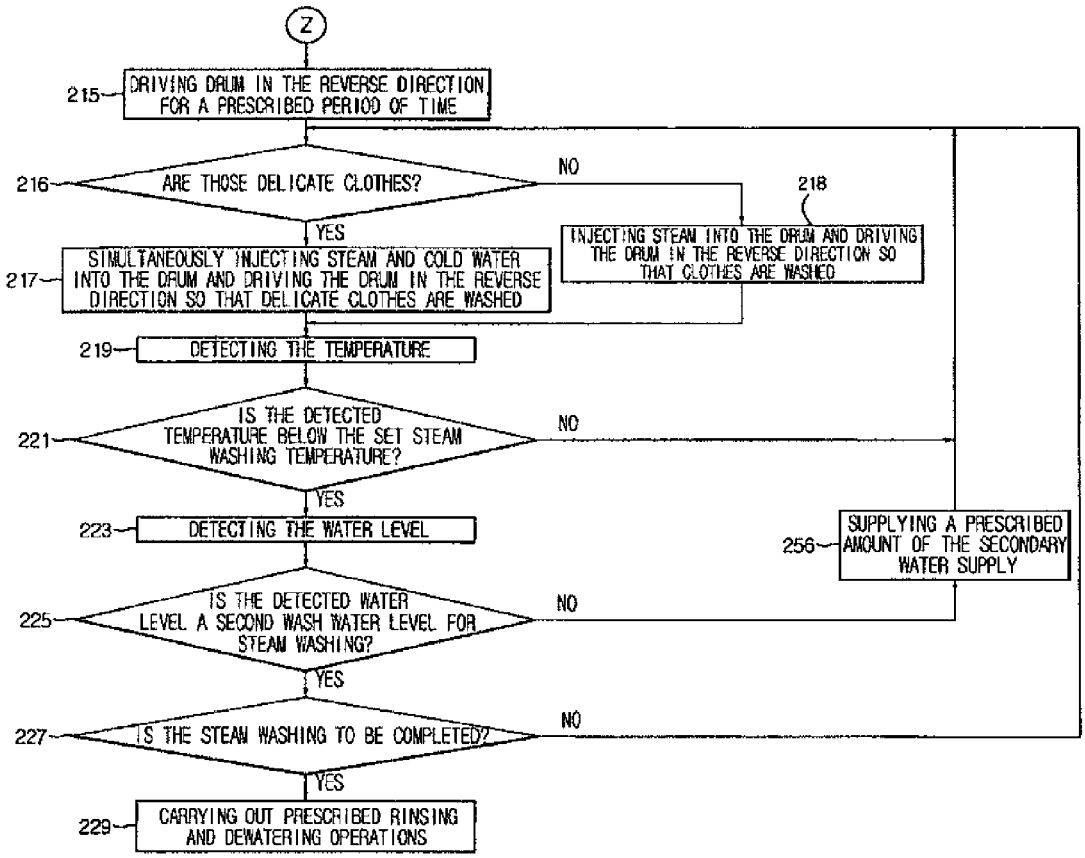

FIGS. 6A and 6B are flow charts illustrating a method of controlling a washing machine in accordance with a second embodiment of the present invention, and FIGS. 7A to 7E are schematic views illustrating respective washing steps in accordance with the control method shown in FIGS. 6A and 6B especially when the laundry is washed using steam.

After the laundry to be washed is put in the rotary drum 11 and a door, which is not shown, is closed, the amount, the material, and the washing temperature of the laundry are set on the basis of setting instructions of a user, which are inputted from the input unit 63 (S201). The microcomputer 61 determines whether it is a washing course for washing the laundry with steam (S203). If it is not determined that the laundry is to be washed with the steam, for example, if it is another washing course for washing the laundry with cold water and a detergent, the washing operation is carried out on the basis of the corresponding washing course (S204).

If it is determined that the laundry is to be washed with the steam at Step S203, the first wash water level for the primary water supply is set by means of the microcomputer 61. The first wash water level A is set on the basis of the amount of the laundry set at Step S201 (S205). The information of the first wash water level A on the basis of the amount of the laundry is previously stored in the storage unit 62.

The microcomputer 61 controls the water supply valve driving unit 66 so that the third water supply valve 5 is opened. Consequently, water introduced from the external water pipe 2 is supplied into the rotary drum through the injection nozzle 13*a* so that the laundry is wetted. At the same time, the microcomputer 61 controls the water supply valve driving unit 66 so that the first water supply valve 3 is opened. Consequently, a powder detergent is supplied into the water tub along with the water introduced through the first water supply pipe 12. The microcomputer 61 also controls the motor driving unit 67 so that the pump motor 18 is driven. Consequently, the water and the powder detergent are supplied into the cylindrical detergent dissolving space 20*b*, where the water and the powder detergent are mixed to obtain a detergent solution. After the detergent solution is obtained, the motor driving unit 67 is controlled by means of the microcomputer 61 so that the pump motor 18 is driven. As a result, the detergent solution in the detergent dissolving space is injected into the rotary drum through the injection nozzle 20*a* so that the detergent solution is sprayed onto the laundry. At this time, the motor driving unit 67 is controlled by means of the microcomputer 61 so that the rotary drum is driven in the reverse direction (S207) (Refer to FIG. 7A).

While the water is supplied, the level of the water in the water tub is detected by means of the first level sensor 64. The microcomputer 61 determines whether the detected level is the first wash water level A (S211). If it is determined that the detected level is not the first wash water level A, the rotary drum is driven in the reverse direction as shown in FIG. 7B so that water is continuously supplied (S212).

Figures 7A, 7B, 7C, 7D, 7E:
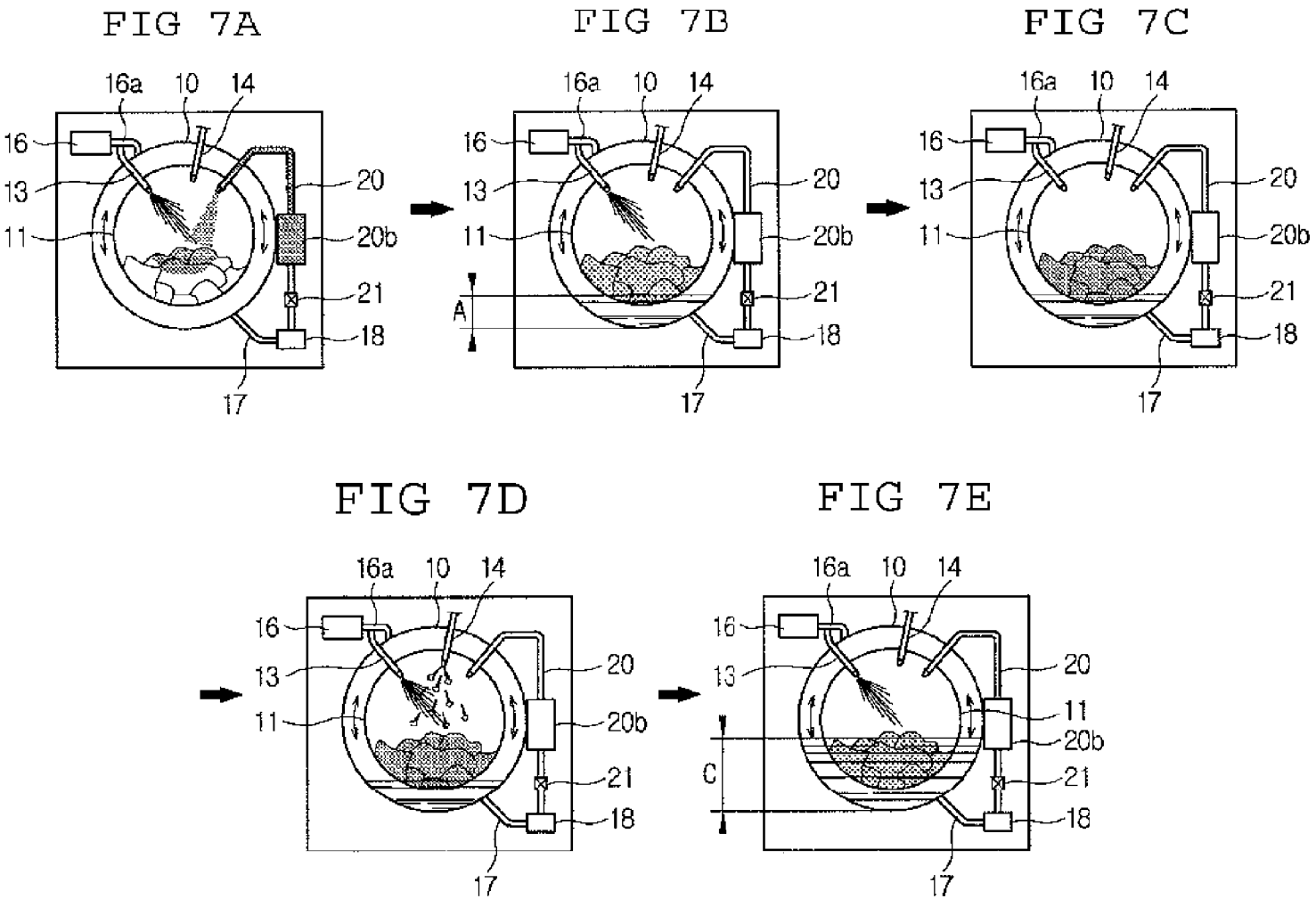
FIGS. 7A to 7E are schematic views illustrating respective washing steps in accordance with the control method shown in FIGS. 6A and 6B.

If it is determined that the detected level is the first wash water level A at Step S212, the valve driving unit 66 is controlled by means of the microcomputer 61 so that the water supply is stopped as shown in FIG. 7C (S213), and the rotary drum is driven in the reverse direction for a prescribed period of time (S215).

The microcomputer 61 determines whether the laundry includes delicate clothes at Step S216. When it is determined that the laundry includes the delicate clothes, the washing operation proceeds to Step S217.

The microcomputer 61 controls the valve driving unit 66 to open the second water supply valve 4 so that a prescribed amount of water is filled in the heating tank 31. The second water supply valve 4 is closed on the basis of the water level detected by means of the second level sensor 34. At the same time, the microcomputer 61 controls the heater driving unit 68 so that the heater 33 is driven. As the heater is driven, the water in the heating tank is heated. When the water is heated and thus steam is generated in the heating tank, the microcomputer 61 controls the valve driving unit 66 so that the steam supply valve 32 is opened.

When it is determined that the laundry includes the delicate clothes, the valve driving unit 66 is controlled by means of the microcomputer 61 so that the third water supply valve 5 is opened.

As a result, the hot steam is injected into the rotary drum through the injection nozzle 14*a* of the second water supply pipe 14. At the same time, cold water is supplied into the rotary drum through the injection nozzle 13*a* of the third water supply pipe 13. Also, the microcomputer 61 controls the motor driving unit 67 so that the rotary drum is driven in the reverse direction. At this time, the hot steam and cold water are simultaneously injected into the rotary drum. Consequently, the delicate clothes are not stained or damaged although the clothes contact the hot steam, whereby the steam washing operation is satisfactorily carried out (S207) (Refer to FIG. 7D).

When it is determined that the laundry does not include the delicate clothes at Step S216, the washing operation proceeds to Step S218 where steam is injected into the drum and the drum is driven in the reverse direction so that the laundry is washed.

While the laundry is washed, the temperature of the water is detected by means of the first temperature sensor 65 (S219). It is determined by means of the microcomputer 61 whether the detected temperature is below the steam washing temperature for steam washing (S221). If it is determined that the detected temperature is not below the steam washing temperature for steam washing, it is returned to Step S217.

If it is determined that the detected temperature is below the steam washing temperature for steam washing at Step S221, the water level in the water tub is detected by means of the first level sensor 64 (S223). It is determined by means of the microcomputer 61 whether the detected level is the second wash water level C for steam washing (S225). If it is determined that the detected level is not the second wash water level C, the rotary drum is driven in the reverse direction as shown in FIG. 7E so that a prescribed amount of water is supplemented (S256), and it is returned to Step S217 so that the steam washing operation is carried out.

If it is determined that the detected level is the second wash water level C at Step S225, the water supply is stopped, and it is determined by means of the microcomputer 61 whether the steam washing operation is to be completed (S227). If it is determined that the steam washing operation is not to be completed, it is returned to Step S217 so that the steam washing operation is carried out.

If it is determined that the steam washing operation is to be completed at Step S227, prescribed rinsing and dewatering operations are carried out (S229).

As apparent from the above description, the amount of wetting water to be supplied is set on the basis of the materials of the laundry according to the first embodiment of the present invention, thereby eliminating bad effects caused when the laundry is washed with steam. According to the second embodiment of the present invention, steam and water are simultaneously supplied into a rotary drum so that the real temperature of the steam contacting the surfaces of the laundry is lowered, thereby eliminating bad effects caused when the laundry is washed with the steam. Although not described in the above-mentioned embodiments, it is possible that the construction for setting the amount of wetting water to be supplied on the basis of the materials of the laundry as in the first embodiment and the construction for simultaneously supplying the steam and the water as in the second embodiment are simultaneously applied to a washing machine, whereby the poor heat-resistant laundry is satisfactorily washed with the steam.

When the laundry is washed with steam, a predetermined amount of wetting water is supplied to the laundry, before the steam is supplied, so that the laundry is wet with the wetting water in accordance with the first embodiment of the present invention. Consequently, the laundry is not damaged due to the steam having a high temperature. Furthermore, when the poor heat-resistant laundry, such as wool, silk, or delicate clothes, is to be washed with steam, the amount of wetting water is increased so that the steam washing operation is carried out while the laundry is sufficiently wet, thereby preventing the laundry from being stained and damaged when the laundry contacts the steam. When the poor heat-resistant laundry, such as wool, silk, or delicate clothes, is to be washed with steam, steam and cold water are simultaneously injected into the rotary drum in accordance with the second embodiment of the present invention, thereby preventing the laundry from being stained and damaged when the laundry contacts the steam.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

The invention claimed is:

1. A method of controlling a washing machine that performs a washing operation using steam, comprising:

selecting a steam washing course;

determining, based on a user input, that laundry received in a rotary drum is delicate clothes;

supplying water to a first water level when it is determined that the laundry is the delicate clothes;

driving the rotary drum in alternating directions for a prescribed period of time to wet the laundry received in the rotary drum; and simultaneously supplying steam and cold water to an interior space of the rotary drum above the wet laundry thereby preventing the laundry from being stained and damaged when the laundry contacts the steam.

2. The method according to claim 1, wherein steam is not supplied during the supplying of the wash water to the first wash water level.

3. The method according to claim 2, further comprising:

rotating the rotary drum simultaneously with supplying of steam and injecting of water into the interior space thereof.

4. The method according to claim 3, wherein the rotary drum is rotated alternatively in forward and reverse directions simultaneously with supplying of steam and injecting of water into the interior space of the rotary drum.

5. The method according to claim 4, further comprising:

supplying water to a second water level in the rotary drum during a steam washing operation, the second water level being higher than the first water level.

6. The method according to claim 5, wherein the water applied to the laundry simultaneously with supplying of steam is injected from an exterior of the rotary drum in a downward direction toward the laundry.

* * * * *